United States Patent [19]

Kouda et al.

[11] Patent Number: 4,828,518

[45] Date of Patent: May 9, 1989

[54] DOUBLE REVERSE REVOLUTION PROPELLER APPARATUS

[75] Inventors: Masatoshi Kouda; Hiroshi Takeshita; Katsumi Yonekura; Noboru Tohge; Hiroyuki Hashimoto; Shoji Fukushima; Sadao Asanabe; Kunio Saki; Susumu Matsumoto; Takao Sasajima, all of Nagasaki, Japan

[73] Assignee: Mitsubishi Jukogyo Kabushiki Kaisha, Tokyo, Japan

[21] Appl. No.: 54,397

[22] Filed: May 26, 1987

[30] Foreign Application Priority Data

| | | | |
|---|---|---|---|
| May 23, 1986 | [JP] | Japan | 61-118870 |
| Oct. 20, 1986 | [JP] | Japan | 61-160693[U] |
| Mar. 31, 1987 | [JP] | Japan | 62-48379[U] |

[51] Int. Cl.[4] ..... B63H 23/00

[52] U.S. Cl. ..... 440/50; 440/75; 440/81

[58] Field of Search ..... 440/75, 80, 81, 50; 416/128, 129, 124, 127, 170 R

[56] References Cited

U.S. PATENT DOCUMENTS

| | | | |
|---|---|---|---|
| 2,196,706 | 4/1940 | Naginskas | 440/81 |
| 3,967,573 | 7/1976 | Charles et al. | 440/50 |
| 4,020,781 | 5/1977 | Bellew | 440/50 |
| 4,619,584 | 10/1986 | Brandt | 416/129 |
| 4,642,059 | 2/1987 | Nohara | 440/81 |

FOREIGN PATENT DOCUMENTS

| | | | |
|---|---|---|---|
| 132220 | 1/1985 | European Pat. Off. | 440/81 |
| 213598 | 10/1985 | Japan | 440/81 |
| 226391 | 11/1985 | Japan | 440/81 |

*Primary Examiner*—Sherman D. Basinger
*Assistant Examiner*—Stephen P. Avila
*Attorney, Agent, or Firm*—Wenderoth, Lind & Ponack

[57] ABSTRACT

A double reverse revolution propeller apparatus includes front and rear propeller wherein the rear propeller is rotated at higher speeds than the front propeller. When seizure occurs, an inner shaft is disconnected from an engine at an inner shaft connection unit and is connected to an outer shaft at an inner and outer shaft connection unit to be driven in the same direction as the outer shaft. The ratio of absorption horsepower of the front propeller to the rear propeller can to be substantially equal to the ratio of rotational speed of the front propeller to that of the rear propeller. One or both of the front and rear propeller can include a variable pitch propeller. The front propeller can have more blades than the rear propeller.

1 Claim, 3 Drawing Sheets

DOUBLE REVERSE REVOLUTION PROPELLER APPARATUS

BACKGROUND OF THE INVENTION

This invention relates to a double reverse propeller apparatus used as a propulsion device for a ship.

Conventionally, there is a double reverse revolution propeller apparatus for a ship, as shown in FIG. 3, in which an inner shaft 8 is provided with a rear propeller 7 at its rear end and is connected at its front end directly to the output shaft 1*a* of a main diesel engine 1 via an intermediate inner shaft 9. An outer shaft 5 is coaxially disposed around the inner shaft 8 and provided with a front propeller 6 at its rear end. The outer shaft is connected at its front end to a reversing device 3' via a hollow shaft 4.

Reversing device 3' is coupled via an elastic coupling 2 to the output shaft 1*a* of engine 1 and converts torque applied thereto via elastic coupling 2 from output shaft 1*a* to a rotation in a direction opposite to the direction in which the output shaft 1a rotates and at the same rotational speed as the speed of the output shaft, and transmits such converted rotation to the shaft 4, outer shaft 5 and front propeller 6.

Outer shaft 5 is supported by an outer shaft bearing 15 provided on the side of the hull of the ship while the inner shaft 8 is supported by an inner shaft bearing 16 inserted between the inner and outer shafts 8 and 5.

In FIG. 3, reference numeral 1*b* denotes a torque branching point, reference numeral 13 an inner shaft thrust bearing, and 14 an outer shaft thrust bearing.

In such dual reverse revolution propeller apparatus, rear propeller 7 receives torque from the output shaft 1*a* of main diesel engine 1 via intermediate inner shaft 9 and inner shaft 8 and is rotated in the same direction as output shaft 1*a*. The front propeller 6 receives torque branched from the output shaft 1*a* via elastic coupling 2, reversing device 3', hollow shaft 4 and outer shaft 5 and is rotated in a direction opposite to that in which rear propeller 7 rotates.

At this time, there are many combinations of the number of blades of propellers 6, 7, engine speeds, and torque distributions. It is said conventionally to be optimal to design front and rear propellers 6 and 7 so that they are rotated in opposite directions at substantially the same rotational speed to produce substantially the same thrust. This is because, when the propellers 6 and 7 are rotated in opposite directions at substantially the same rotational speed, the rotational energy in the flow of the fluid after the front propeller 6 is recovered most efficiently by the rear propeller 7, to thereby improve the propulsion efficiency.

It is to be noted that the thrust generated by the front and rear propellers 6 and 7 are transmitted via outer shaft 5 and inner shaft 8 from outer and inner shaft thrust bearings 14 and 13 to the hull.

That portion of a double reverse revolution propeller apparatus for a ship such as that mentioned above which is most difficult technically to put to practical use is inner bearing 16 which supports inner shaft 8 within outer shaft 5. Inner shaft bearing 16 may be one of various types which include a floating bush type, a hydrostatic bearing type, a roller bearing type, etc. However, it is very difficult to provide inner shaft 16 having a sufficient load capacity between inner and outer shafts 8 and 5 which rotate at equal speeds in opposite directions, even if one of these types of bearings is used. Seizure may occur with high probability.

Consider the load capacity of a bearing in which the outer and inner shafts 5 and 8 are respectively rotating at speeds U2, U1 in opposite directions, as shown in FIG. 5.

(1) Consider the cross section taken along the line 1– 2. By a relative shaft rotation U1+U2, speeds of running fluids (i.e. lubricant) $U_{Qi}$ and $U_{Qo}$ are produced on the surface of both the shafts. When outer and inner shafts 5 and 8 rotate at equal speeds in opposite directions (U1 +U2 =0), both the net quantities of forced bearing lubricant oil Qi and Qo obtained by integrating UQi and UQo, respectively, in the radial direction of the shafts become zero.

(2) Since there are zero net quantities of forced oil in the case of equal reverse revolutions, as mentioned above, neither wedge action nor oil film pressure will be produced.

(3) Therefore, since there is no oil film pressure opposing the load of inner shaft 8, metal contact will occur between the inner and outer shafts or between the inner shaft and the bearing therefor and hence seizure may occur.

Pressure distribution in the oil film, as shown in FIG. 5, is theoretically shown by the following Reynolds Equation $$\frac{\partial}{\partial x}\left(h^3\frac{\partial P}{\partial x}\right)+\frac{\partial}{\partial x}\left(h^3\frac{\partial p}{\partial y}\right)=6\mu(U1+U2)\frac{\partial h}{\partial x} \quad (1)$$

where P is pressure, h is spacing distribution, $\mu$ is oil viscosity, U1 is the peripheral speed of the inner shaft, U2 is the peripheral speed of the outer shaft, x is a circumferential coordinate whose center is the center of the outer shaft, and y is an axial coordinate.

The right side of Equation (1) is called "wedge action". In the case of equal reverse rotations, U1+U2=0. Therefore, there is no wedge action. Therefore, no oil film pressure P obtained by solving the left side of Equation (1) will be produced.

As described above, if a plain bearing is used between outer and inner shafts 5 and 8 which rotate at the same rotational speed in opposite directions, there is no net quantity of oil forced into the spacing between the inner and outer shafts because there is no difference in rotational speed between the outer and inner shafts (there is no difference in peripheral speed between the rotating surfaces of the inner and outer shafts). Thus no "wedge action" of the lubricant will occur, the inner shaft 8 will not float by oil pressure, thereby causing metal contact and hence seizure.

If the inner shaft bearing 16 is seized in such dual reverse revolution propeller shaft system, the shaft system driving of the ship will seriously be influenced, for example, the ship will not be able to navigate.

It could be conceived that if inner shaft bearing 16 is seized, the torque transmitted to reversing device 3' is interrupted, the inner and outer shafts 8 and 5 are tightly fastened so that they rotate in the same direction to thereby prevent an increase in damage due to seizure of the inner shaft 16.

Since the thrusts produced by the front and rear propellers 6 and 7 rotating at the same rotational speeds in opposite directions are equal in the conventional double reverse revolution propeller apparatus, however, they would cancel each other although the front and rear propellers 6 and 7 may be driven in the same direction by fastening the inner and outer shafts tightly. As a result the ship will not be able to navigate.

In the case of an equal-speed reverse rotation system in which the front and rear propellers rotate at substantially the same rotational speed in opposite directions, it is necessary to use parallel shaft gears or a two-stage planetary gear, etc. However, these devices are large-size, complex and expensive.

It is therefore an object of this invention to drive front and rear propellers using a small simple apparatus and to prevent seizure of the inner shaft bearing.

It is another object of this invention to provide a highly practical double reverse revolution propeller apparatus which is cable of producing a thrust and capable of emergency self-navigation even if the inner and outer shafts are tightly fastened and rotated in the same direction even when seizure may occur at the inner shaft bearing.

Further, in the conventional double reverse revolution propeller apparatus, the arrangement is such that the absorption horsepowers of front and rear propellers 41 and 42, as shown in FIG. 4, are usually equal.

Since the propeller torque is proportional to the absorption horsepower/engine speed, and if the front and rear porpellers 41 and 42 are set to be equal in absorption horsepower when they are different in rotational speed, a swirling flow 45 downstream of the propeller as a reaction of the propeller torque would not be cancelled completely, as shown by 45*a* in FIG. 4 and the energy of such swirling flow accordingly would be lost. It is to be noted that in FIG. 4, reference numeral 43 denotes a flow along the outer end of the propeller, 44 a swirling flow downstream of the front propeller, 46 the direction of rotation of the front propeller, and 47 the direction of rotation of the rear propeller.

This invention is intended to solve the above problems. It is an object of this invention to provide a double reverse revolution propeller apparatus in which the ratio of absorption horsepower of the front propeller to that of the rear propeller is equal to the ratio of rotational speed of the front propeller to that of the rear propeller to cancel the swirling flows of the front and rear propellers, to decrease loss of the rotating energy by the propellers and to thereby improve the propulsion efficiency of the ship.

In the conventional propeller apparatus shown in FIG. 4, the diameter of rear propeller 42 is designed so as to contact flow 43 along the outer edge of front propeller 41, while in the double reverse revolution propeller apparatus in which the front and rear propellers 41, 42 are equal in rotational speed, the front propeller 41 has a smaller number of blades than the rear propeller 42. In this case, if the number of blades of the respective propellers is selected incorrectly, the swirling flows downstream of the propeller will remain not completely cancelled.

This invention is intended to solve this problem. It is an object of this invention to provide a dual reverse revolution propeller apparatus which has a simplified reverse revolution mechanism for the propeller shaft while cancelling the swirling flows downstream of the front and rear propellers sufficiently to reduce loss of the rotating energy of the propellers, thereby improving the propulsion efficiency of the ship.

SUMMARY OF THE INVENTION

Thus, this invention provides a dual reverse revolution propeller apparatus with front and rear propellers in which the rear propeller rotates at a higher rotational speed than the front propeller.

This invention provides a dual reverse revolution propeller shaft system for a ship, and including an inner shaft having a rear propeller at its rear end and an outer shaft having a front propeller at its rear end and provided around the inner shaft, an outer shaft bearing provided on the hull for supporting the outer shaft, and an inner shaft bearing inserted between the inner shaft and the outer shaft for supporting the inner shaft. The rear propeller at the rear end of the inner shaft rotates at higher speeds than the front propeller at the rear end of the outer shaft. An inner shaft connection unit can separate the inner shaft from an engine, the inner shaft connection unit being disposed at a position after a branching point of torque applied by the engine to the inner and outer shafts and before the inner shaft bearing. An inner and outer shaft connection unit is provided at a position between the inner shaft connection unit and the inner shaft bearing for allowing connection of the inner shaft to the outer shaft.

This invention provides a double reverse revolution propeller apparatus having front and rear propellers having different rotational speeds, wherein the ratio of absorption horsepower of the front propeller to the rear propeller is substantially eqal to the ratio of rotational speed of the front propeller to that of the rear propeller.

A double reverse revolution propeller apparatus according to this invention in which the front propeller has a different rotational speed than the rear propeller is characterized in that the front propeller has more blades than the rear propeller.

In the dual reverse revolution propeller apparatus according to this invention, the front and rear propellers are rotated in opposite directions so that the rear propeller has a higher rotational speed than the front propeller during normal navigation.

Therefore, as described above, with reference to FIG. 5, a difference in peripheral speed will occur between the corresponding rotating surfaces of the inner and outer shafts to provide a net quantity of oil forced into the spacing between the inner and outer shafts to thereby produce the "wedge action" of a lubricant into the spacing between the inner and outer shafts. Therefore, when a plain bearing is used between the inner and outer shafts, an oil film pressure due to the "wedge action" will occur to prevent seizure. When another type of bearing is used, the reliability of the inner shaft bearing is highly improved because the effect of the "wedge action" is combined with the advantage of such type of the bearing.

During emergency navigation in which seizure of an inner shaft bearing occurs, the inner shaft is separated from the engine at the inner shaft connection unit and is connected to the outer shaft at the inner and outer shaft connection unit so that it is rotated in the same direction as the outer shaft.

Since the front propeller is rotated at a lower speed than the rear propeller in a direction opposite to that in which the rear propeller is rotated, a small-sized inexpensive star type planetary gear or the like can be used as a reversing mechanism in the dual reverse revolution shaft system having coaxial inner and outer shafts.

In the dual reverse revolution propeller apparatus according to this invention, the ratio of absorption horsepower of the front propeller to the rear propeller is set substantially equal to the ratio of rotational speed of the front propeller to the rear propeller, so that the front propeller is substantially equal in torque to the rear propeller in which the propeller torque is proportional to the absorption horsepower/rotational speed thereof, both swirling flows downstream of and produced by both the propellers as a reaction between both the propellers are substantially equal in magnitude and cancelled by each other.

When the front propeller has a lower rotational speed than the rear propeller, the optimum diameter of the front propeller usually becomes large. However, due to limitations of the apparatus, a propeller with a larger diameter cannot be fitted in. In this invention, in order to keep higher efficiency, a propeller with a smaller optimum diameter by increasing the number of blades is utilized within a range limited by the stern configuration.

On the other hand, since the rear propeller has a higher rotational speed than the front propeller, the optimum diameter of the rear propeller decreases. However, in order to adjust the propeller diameter of the rear propeller to the accelerated slip stream of the front propeller keeping the efficiency of the propeller maximum, the diameter of a propeller with a larger optimum diameter is decreased.

Since, in the dual reverse revolution propeller apparatus according to this invention, the front propeller has more blades than the rear propeller, a swirling flow equal in intensity and opposite in direction to that produced by the front propeller can be produced by the rear propeller, so that the swirling flow from the front propeller can be cancelled.

DETAILED DESCRIPTION

Figure 1A:
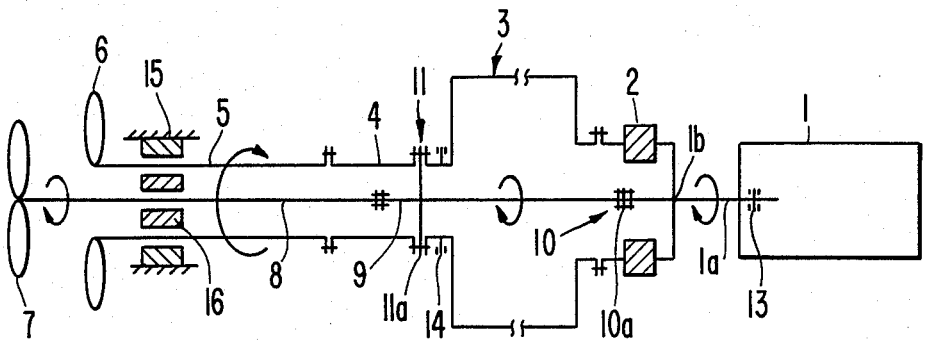
FIGS. 1(*a*) and 1(*b*) illustrate a dual reverse revolution propeller apparatus according to a first embodiment of this invention, wherein FIG. 1(*a*) is a schematic view showing the state of the apparatus during normal ship navigation and FIG. 1(*b*) is a schematic view showing the state of the apparatus during emergency navigation.
Figure 1B:
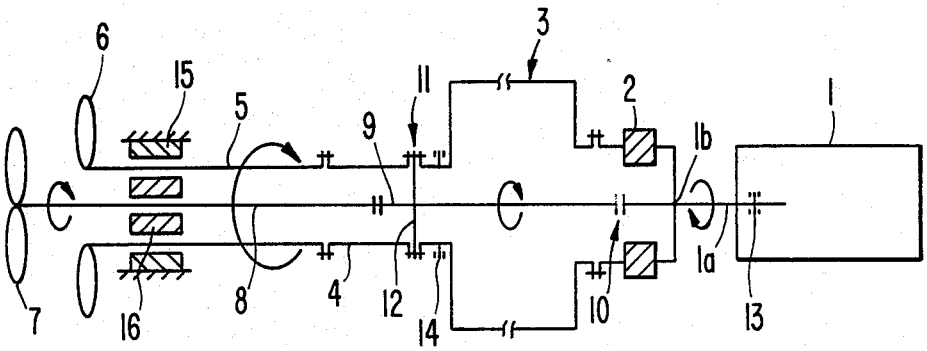

A double reverse revolution propeller apparatus according to a first embodiment of this invention will now be described with reference to FIGS. 1(*a*) and 1(*b*) wherein. FIG. 1(*a*) is a schematic view showing the state of the apparatus during normal ship navigation and FIG. 1(*b*) is a schematic view showing the state of the apparatus during emergency navigation.

As shown in FIGS. 1(*a*) and 1(*b*) , similarly to the prior art, this embodiment also includes inner shaft 8 having rear propeller 7 at its rear end and connected at its front end to the output shaft 1(*a*) of main diesel engine 1 via intermediate inner shaft 9. Outer shaft 5 is disposed coaxially around inner shaft 8 and has front propeller 6 at its rear end. Coupled to the front end of outer shaft 5 is a reversing device 3 with a reduction gear via a hollow shaft 4. Outer shaft 5 is supported by outer shaft bearing 15 provided on the hull while inner shaft 8 is supported by inner shaft bearing 16 inserted between inner shaft 8 and outer shaft 5.

In this embodiment, reversing device 3 is coupled via elastic coupling 2 to output shaft 1*a* of engine 1. Device 3 reduces the rotational speed applied thereto via elastic coupling 2 to less than 90% of the rotational speed of output shaft 1*a* and reverses the rotating direction thereof. The torque is transmitted to hollow shaft 4 outer shaft 5 and front propeller 6.

Therefore, the rear propeller 7 is rotated via inner shaft 8 and intermediate inner shaft 9 at the same rotational speed and in the same direction as output shaft 1a, while the front propeller 6 is rotated at a lower speed than output shaft 1*a* or the rear propeller 7 in a direction opposite to that in which the rear propeller 7 is rotated, because the front propeller 6 is decelerated by reversing device 3. In this embodiment, under such conditions, the front and rear propellers 6 and 7 are designed so as to produce substantially the same forward thrust by adjusting the number of blades of each of the propellers, the pitch of the propeller blades, etc.

A spacer 10*a* is provided between output shaft 1a and intermediate inner shaft 9 at a point after the branching point of torque from engine 1 to inner and outer shafts 8 and 5 and before inner shaft 8 so as to construct an inner shaft coupling unit 10 to interrupt inner shaft 8 and intermediate inner shaft 9 from engine 1.

An inner and outer shaft coupling unit 11 is constructed such that a spacer 11*a* is provided during normal navigation between reversing device 3 and hollow shaft 4 at a location between inner shaft coupling unit 10 and inner shaft bearing 16, while a torque transmission member 12 is provided to couple inner shaft 8 and intermediate inner shaft 9 to outer shaft 5 and hollow shaft 4 during emergency navigation in which, for example, inner shaft bearing 16 is seized.

In FIGS. 1(*a*) and 1(*b*) reference numeral 13 denotes an inner shaft thrust bearing which transmits a thrust by rear propeller 7 via inner shaft 8, intermediate inner shaft 9 and output shaft 1*a* to the hull, and 14 an outer shaft thrust bearing which transmits a thrust by front propeller 6 via hollow shaft 4 to the hull.

The propeller apparatus of this embodiment of invention is constructed as described above, so that during normal navigation a torque is transmitted from the output shaft 1*a* of engine 1 (for example, having a maximum output of 20,000 PS and a rotational speed of 63 rpm) via intermediate inner shaft 9 and inner shaft 8 to rear propeller 7 to thereby rotate at the same rotational speed (63 rpm) as output shaft 1*a* and in the same direction, as shown in FIG. 1(*a*).

As in the prior art, front propeller 6 receives a torque branched from output shaft 1*a* via elastic coupling 2, reversing device 3, hollow shaft 4 and outer shaft 5 to be rotated in a direction opposite to that in which rear propeller 7 is rotated. In this embodiment, the torque from output shaft 1*a* is changed in direction and further reduced in rotational speed (for example, from 63 rpm to 35 rpm) at reversing device 3 with a reduction mechanism to be transmitted to front propeller 6.

Therefore, rear propeller 7 is rotated at higher speed than front propeller 6. In this embodiment, under such condition, both of the front and rear propellers produce substantially the same forward thrust (for example, 10,000 PS). These thrusts are transmitted from outer and inner shaft thrust bearings 14, 13 to the hull so as to advance the ship, for example, at about 14 knots.

As described above, according to this embodiment, since outer and inner shafts 5 and 8 are rotated in opposite directions, an oil film pressure due to the "wedge action" will be produced to float inner shaft 8 by the hydraulic action to thereby prevent seizure.

If inner shaft bearing 16 should be seized during normal navigation such as that mentioned above, it is difficult to rotate inner and outer shafts 8 and 5 in opposite directions. Under such a condition, the engine is temporarily stopped. As shown in FIG. 1(*b*), spacer 10*a* is then removed from inner shaft coupling unit 10 to separate inner shaft 8 and intermediate inner shaft 9 from engine 1. Spacer 11*a* is then removed from inner and outer shaft coupling unit 11 and torque transmission member 12 is mounted on intermediate inner shaft 9 and inserted between hollow shaft 4 and reversing device 3 so as to couple inner shafts 8 and 9 to outer shaft 5 and hollow shaft 4.

Under this condition, the output from engine 1 is reduced to a value (about 10,000 PS) corresponding to an allowable torque of elastic coupling 2 to rotate output shaft 1*a* at appropriate an rotational speed (for example, 50 rpm). The output torque from output shaft 1*a* is then transmitted via elastic coupling 2 to reversing device 3 without being transmitted to intermediate inner shaft 9. The torque transmitted to the reversing device 3 is changed in direction and reduced in magnitude (from 50 rpm to 28 rpm), transmitted via hollow shaft 4 and outer shaft 5 to front propeller 6, and via torque transmission member 12, intermediate inner shaft 9 and inner shaft 8 to rear propeller 7.

Therefore, the inner and outer shafts 8 and 5 and the rear and front propellers 7 and 6 are rotated as a unit in the same direction (in the direction opposite to the direction of rotation of output shaft 1*a*).

At this time, a forward thrust occur at the front propeller 6, while rear propeller 7 is rotated in the direction opposite to the direction in which it is rotated during normal navigation, thereby producing a backward thrust. Since the rear propeller 7 is formed so as to produce the same forward thrust as front propeller 6 at higher speeds than front propeller 6 during normal navigation, the backward thrust produced by rear propeller 7 when rear propeller 7 is rotated at the same rotational speed (28 rpm) as front propeller 6, as described above, is considerably reduced (to, for example, about 800 PS compared to 5,000 PS) compared to the forward thrust produced by front propeller 6 at the same speed (28 rpm).

Thus, the forward thrust by front propeller 6 is not cancelled by the backward thrust by rear propeller 7 and is transmitted from outer shaft thrust bearing 14 to the hull to thereby perform emergency navigation (according to the above described example of numerical values, a forward thrust of 4,200 PS is obtained to permit forward navigation at about 3 knots).

It is to be noted that the output and rotational speed of engine 1 during emergency navigation such as that mentioned above are appropriately set so as not to cast a burden on the strength and/or performance of elastic coupling 2, reversing device 3, outer shaft thrust bearing 14, etc.

Since the front and rear propellers rotate at different speeds and in opposite directions, a simple star gear may be used as a reversing mechanism for coaxially arranged inner and outer shafts 8 and 5.

As described above, according to this embodiment, seizure of inner shaft bearing 16 in the double reverse revolution propeller shaft system is prevented using a simply structured apparatus. Even if inner and outer shafts 8 and 5 cannot be rotated in opposite directions due to seizure, they can be fastened tightly via torque transmission member 12 and rotated in the same direction to thereby produce a sufficient forward thrust to permit emergency navigation. Therefore, an increase in the damage due to seizure of inner shaft bearing 16 can be prevented, and the practicality of the propeller apparatus can be improved greatly.

A dual reverse revolution propeller apparatus according to a second embodiment of the invention will now be described with reference to FIG. 2.

Figure 2:
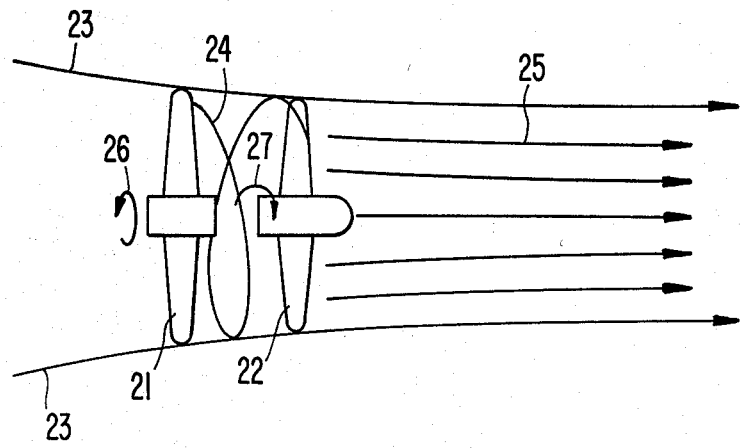
FIG. 2 is a schematic side view showing a double reverse revolution propeller apparatus according to a second embodiment of this invention.
Figure 3:
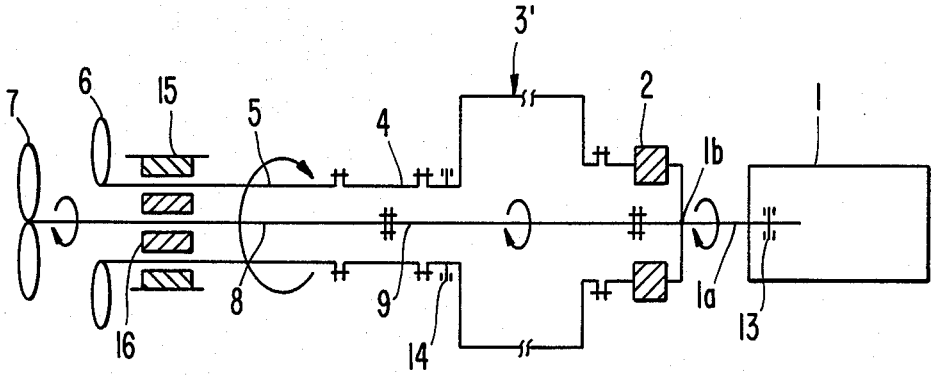
FIGS. 3 and 4 are schematic side views showing conventional double reverse revolution propeller apparatuses.
Figure 4:
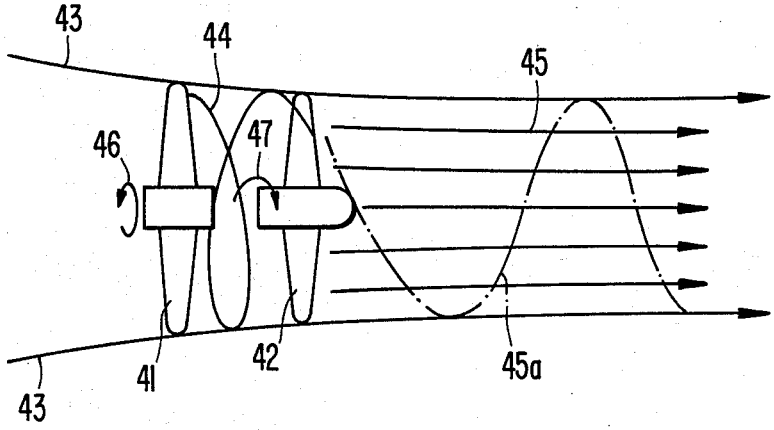
Figure 5:
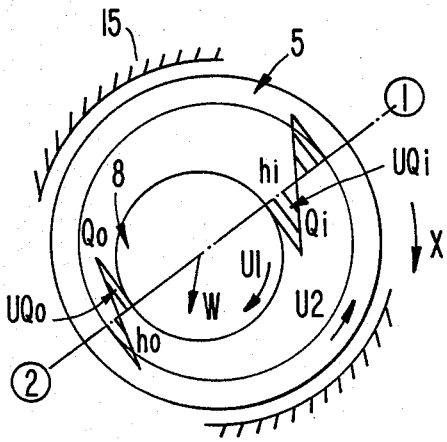
FIG. 5 illustrates the state of a lubricant in a bearing.

As shown in FIG. 2, front and rear properllers 21 and 22 are coaxially disposed in tandem and adapted to be rotated by respective drive mechanisms, not shown, in opposite directions. For example, in FIG. 2, front propeller 21 is rotated counterclockwise as shown by 26 opposite to a flow of water passing through front and rear propellers 21, 22 while rear propeller 22 is rotated clockwise as shown by 27.

Front and rear propellers 21 and 22 are rotated at respective different speeds. The ratio of absorption horsepower of front propeller 21 to rear propeller 22 is substantially equal to the ratio of rotational speed of the front propeller to that of the rear propeller.

For example, one or both of the front and rear propellers may be a variable pitch propeller by which its absorption horsepower can be freely adjusted. A control system is provided to satisfy the above conditions, namely, to adjust the pitch of the variable pitch propeller so that the ratio of absorption horsepower of the front propeller 21 to that of the rear propeller 22 is substantially equal to the ratio of rotational speed of the front propeller to that of the rear propeller at all times.

In FIG. 2, reference numeral 23 denotes a flow along the outer edge of the propellers and reference numeral 25 a flow downstream of rear propeller 22.

Since the propeller apparatus of the second embodiment of this invention is constructed as described above, the magnitudes of the propeller torques, each of which is proportional to its absorption horsepower/rotational speed during operation of the corresponding propeller, are substantially equal to each other although the front and rear propellers rotate at different speeds.

Swirling flows downstream of the front and rear propellers as a reaction therebetween have substantially the same intensity and opposite directions, so that they are cancelled by each other to thereby greatly decrease loss of swirling energy in the flow 25 downstream of the front and rear propellers.

Thus the propeller efficiency is improved, the cost required for navigation of the ship is reduced, and the propulsion performance of the ship is improved.

A third embodiment of this invention will now be described. The arrangement of the front and rear propellers and other structural portions are similar to those of the embodiment shown in FIG. 2. In this embodiment, for example, in FIG. 2, front propeller 21 is rotated counterclockwise, as shown by 26, opposite to a flow of water passing through front and rear propellers 21 and 22 while rear propeller 22 is rotated clockwise as shown by 27. Now the rotational speeds of the front and rear propellers 21 and 22 are designated by N1 and N2, respectively. If N2/N1 is nearly equal to 1.4, the number of blades of the front propeller 21 is selected to be four while the number of blades the rear propeller 22 is selected to be three. This causes the outer diameter (tip) of rear propeller 22 to substantially contact the outer flow 23 produced by the front propeller 21.

In this way, the pitch of the front and rear propellers 21 and 22 should be selected so that the swirling flows downstream of the front and rear propellers 21 and 22 have substantially the same intensity. Since the swirling flows have opposite directions, they are cancelled by each other to thereby greatly reduce loss of swirling energy in the flow 25 downstream of the front and rear propellers.

As described above in detail, according to a double reverse revolution propeller apparatus of this invention, seizure of the inner-shaft bearing is prevented using a simple structure. If an accident such as seizure occurs and inner and outer shafts are fastened tightly and rotated in the same direction, a forward thrust can be produced, so that an increase in the damage due to seizure of the inner shaft bearing is prevented while permitting emergency self-navigation, thereby greatly improving the practicality of the double reversing revolution propeller apparatus.

As described above in detail, the inventive double reverse revolution propeller apparatus in which the front and rear propellers rotate at different rotational speeds has a simple structure in which the ratio of absorption horsepower of the front propeller to the rear propeller is set to be substantially equal to the ratio of rotational speed of the front propeller to the rear propeller, so that even if the rotational speeds of the front and rear propellers are different, the swirling flows downstream of both the propellers are cancelled by each other at all times to thereby reduce loss of the swirling energy greatly. This improves the propeller efficiency and in turn contributes to reduction of the cost of navigation of the ship and to improvements in the propulsion performance of the ship.

As described above in detail, according to a double reverse revolution propeller apparatus in which the front and rear propellers rotate in different rotational speeds, the front propeller has more blades than the rear propeller, so that the diameter of the front propeller can be selected so as to be accommodated to the stern configuration of the hull, and also the diameter of the rear propeller can be selected so as to make the tips of the rear propeller blades contact the outer flow produced by the front propeller.

What is claimed is:

1. In a double reverse revolution propeller apparatus for a ship and including a front propeller and a rear propeller, wherein said rear propeller is rotated at higher speeds than said front propeller by means of a propeller shaft system to be provided in the ship and comprising:

an inner shaft having at a rear end thereof said rear propeller and having at a front end thereof means for connecting said inner shaft to a drive shaft of an engine of the ship;

an outer shaft disposed coaxially around said inner shaft, said outer shaft having at a rear end thereof said front propeller and having at a front end thereof means for rotating said outer shaft in a direction opposite to the direction of rotation of said inner shaft and at a speed lower than the speed of rotation of said inner shaft;

an outer shaft bearing for supporting said outer shaft on a hull of the ship;

an inner shaft bearing disposed between said inner shaft and said outer shaft for supporting said inner shaft;

inner shaft connection unit means located at a position between said rotating means and said inner shaft bearing, for, upon seizing of said inner shaft bearing, selectively separating said inner shaft from driving connection with the engine driving shaft; and inner and outer shaft coupling unit means, located at a position between said inner shaft connection unit means and said inner shaft bearing, for coupling said inner shaft to said outer shaft when said inner shaft is separated from driving connection with the engine driving shaft, and thereby for enabling said inner shaft and said rear propeller to be driven by said outer shaft in the same direction as said outer shaft.

* * * * *